United States Patent [19]

Jones

[11] 4,140,342

[45] Feb. 20, 1979

[54] ROCKABLE AGAINST-THE-WALL TYPE RECLINING CHAIR

[76] Inventor: W. Dale Jones, 7020 Aztec Dr., NE., Albuquerque, N. Mex. 87110

[21] Appl. No.: 840,667

[22] Filed: Oct. 11, 1977

Related U.S. Application Data

[63] Continuation-in-part of Ser. No. 720,244, Sep. 3, 1976, Pat. No. 4,057,289.

[51] Int. Cl.[2] ..... A47C 3/02

[52] U.S. Cl. ..... 297/261; 297/318; 297/344; 297/DIG. 7

[58] Field of Search ..... 297/259, 261, 264–266, 297/270–272, 310, 311, 327, 329, 344, DIG. 7, 84, 88, 318

[56] References Cited

U.S. PATENT DOCUMENTS

| | | | |
|---|---|---|---|
| 144,603 | 11/1873 | Enger | 297/329 |
| 465,719 | 12/1891 | Mitchell | 297/266 X |
| 665,261 | 1/1901 | Harmon | 297/261 |
| 2,270,172 | 1/1942 | Ruegger | 297/329 |
| 2,940,509 | 6/1960 | Fletcher | 297/329 X |
| 3,295,885 | 1/1967 | Barksdale | 297/271 X |
| 3,669,490 | 6/1972 | Bertolet | 297/272 |
| 3,730,585 | 5/1973 | Rogers et al. | 297/DIG. 7 |
| 3,758,151 | 9/1973 | Re | 297/259 X |
| 4,072,342 | 2/1978 | Johnson et al. | 297/84 |

*Primary Examiner*—James C. Mitchell
*Attorney, Agent, or Firm*—Learman & McCulloch

[57] ABSTRACT

A rockable against-the-wall type reclining chair which may be gravitationally biased either to a normal upright against-the-wall position or to a forwardly projected away-from-the wall position relative to a base upon which rocking and reclining movement of the chair back can occur with sufficient clearance from the adjacent wall. A chair frame supports the chair seat and back units by means of a conventional reclining mechanism for movement relative to the chair frame between normal upright and reclined positions. The chair frame, in turn, is rockably mounted upon a carriage which is mounted upon a base unit by a roller track arrangement for movement relative to the base between forward and rearward limits of movement. Four embodiments are disclosed. In one embodiment, the base is rockable and the tracks are fixedly mounted on the base. In a second embodiment, the base is fixed and the tracks are supported for pivotal movement on the base. In a third embodiment, the tracks constitute a portion of the carriage and receive rollers which are mounted on the stationary base and which are arranged to accommodate rocking movement of the carriage relative to the base. In these three embodiments occupant initiated forward tilting of the tracks is employed to gravitationally bias the carriage to its forward position. In the fourth embodiment, the tracks are fixedly mounted on the base in a downwardly and forwardly inclined position and the carriage is normally retained at its rearward end limit of movement by a detent like arrangement which can be overcome by a forward shifting movement of the occupant of the chair. In each embodiment, a return spring arrangement is provided which automatically restores the carriage to its rearward limit of movement when the occupant arises from the chair.

19 Claims, 15 Drawing Figures

ROCKABLE AGAINST-THE-WALL TYPE RECLINING CHAIR

REFERENCE TO RELATED APPLICATIONS

This application is a continuation-in-part of my copending application Ser. No. 720,244, filed Sept. 3, 1976, now U.S. Pat. No. 4,057,289.

BACKGROUND OF THE INVENTION

In my U.S. Pat. No. 4,057,289, I have disclosed two forms of rockable against-the-wall type reclining chairs, one designed to provide for rocking of previously known against-the-wall type reclining chairs and the other to render previously known rockable reclining chairs norally locatable against the wall.

Prior to the first form of the invention disclosed in my U.S. Pat. No. 4,057,289, the coupling between the reclining linkage and the base via the translation linkage prevented conventional against-the-wall type reclining chairs from being rocked. In my U.S. Pat. No. 4,057,289, a rocking capability is provided in conventional against-the-wall type reclining chairs by virtue of a latching mechanism which enables the translation linkage to be uncoupled from the base, and a rectilinearly translatable roller carriage interposed between the chair frame and the chair base.

Prior to the second form of the invention disclosed in my U.S. Pat. No. 4,057,289, normal against-the-wall location of conventional rockable reclining chairs was prevented by the fixed relationship of the chair frame and the chair base in the horizontal plane. In my U.S. Pat. No. 4,057,289, normal against-the-wall location capability is provided in conventional rockable reclining chairs by virtue of a rectilinearly translatable roller carriage interposed between the chair frame and the chair base.

In both forms of the invention it is necessary to manually return the chain to the wall following the reclining and rocking functions, either by remaining seated and scooting the chair backwardly or by arising and pushing the chair backwardly.

The present invention is directed toward a roackable against-the-wall type reclining chair not requiring a translation linkage system, and providing for automatic return of the chair to the wall as one arises following the reclining and rocking functions.

SUMMARY OF THE INVENTION

A chair constructed according to the present invention finds the chair seat, back, and in the usual case a foot rest, supported on a chair frame by a reclining linkage which may take the form of any of a large number of conventional, commercially available reclining chair linkages. The chair frame is in turn supported for rocking movement upon a carriage which is in turn supported by a roller track arrangement upon a base for movement between forward and rearward limits of movement relative to the base. The carriage is normally maintained at its rearward limit of movement relative to the base in which the chair, when disposed in its normal upright position, may be located with the back of the chair closely adjacent a wall surface. When it is desired to rock or to recline the chair, the carriage is shifted, by the structure descried below, to its forward limit of movement relative to the base, at which the chair back is spaced a sufficient distance from the wall to provide the necessary clearance for rocking and reclining movements of the chair back.

The carriage is supported upon the base by rollers mounted on one of the carriage and base elements (depending on the embodiment) which are received within tracks mounted upon the other element. In all but one embodiment, tilting of the tracks (or carriage) between either a forwardly inclined orientation or a rearwardly inclined orientation thus gravitationally biases the carriage to either its forward or rearward limit of movement relative to the base. In the other embodiment, the tracks are fixedly tilted forwardly and the carriage is releasably retained at the rearward limit by a detent arrangement. Except for the fourth embodiment the center of gravity of the chair elements supported upon the carriage is so located to gravitationally maintain the tracks or carriage in a rearwardly tilted position when the carriage is at its rearward limit of movement. A return spring assembly biases the carriage toward this rearward limit of movement when the carriage is at its forward limit of movement. When the chair is occupied and is located at its forward limit of movement, the weight of the carriage supported chair elements plus that of the occupant is sufficient to overcome the biasing action of the return spring and the chair, while occupied, is retained at its forward limit of movement to permit rocking or reclining of the chair. When the occupant arises from the chair, the gravitational bias exerted merely by the weight of the carriage supported chair elements is less than the restoring bias of the return spring, and the carriage is thus automatically returned to its rearward limit of movement.

Four embodiments of the invention are disclosed and are best described as the rockable base embodiment, the rockable track embodiment, the rockable carriage embodiment, and the fixed track embodiment. In the rockable base embodiment the under surface of the base side frame members is formed to provide a rearward flat surface upon which the chair normally rests, and a relatively inclined forward flat surface upon which the chair rests while being reclined and rocked. The roller tracks are fixedly attached to the base such that the tracks normally tilt downwardly toward the rear. When the base is rocked forwardly, the tracks likewise rock forwardly to a downwardly and forwardly tilted position, at which time the carriage will run forwardly along the tracks to its forward limit of movement.

In the rockable track embodiment, the base is stationary and the tracks are pivotally mounted upon the base so that they can be rocked between a rearwardly inclined position and a forwardly inclined position.

In the rockable carriage embodiment, the track elements constitute side frame members of the carriage and are supported by rollers mounted on the base. The rollers are so related to each other that rocking movement of the carriage between a rearwardly inclined position of the tracks and a forwardly inclined position of the tracks can be accomplished to gravitationally shift the carriage between its forward and rearward limits of movement.

In the fixed track embodiment, the tracks are fixedly mounted in a forwardlly tilted position. A depressed portion in the tracks releasably retains the carriage rollers to maintain the carriage at its rearward end limit, and forward rocking motion by the chair occupant will urge the rollers out of these depressions to allow the carriage to move to its forward limit by rolling down the inclined tracks.

Other objects and features of the invention will become apparent by reference to the following specification and to the drawings.

IN THE DRAWINGS

Figure 1:
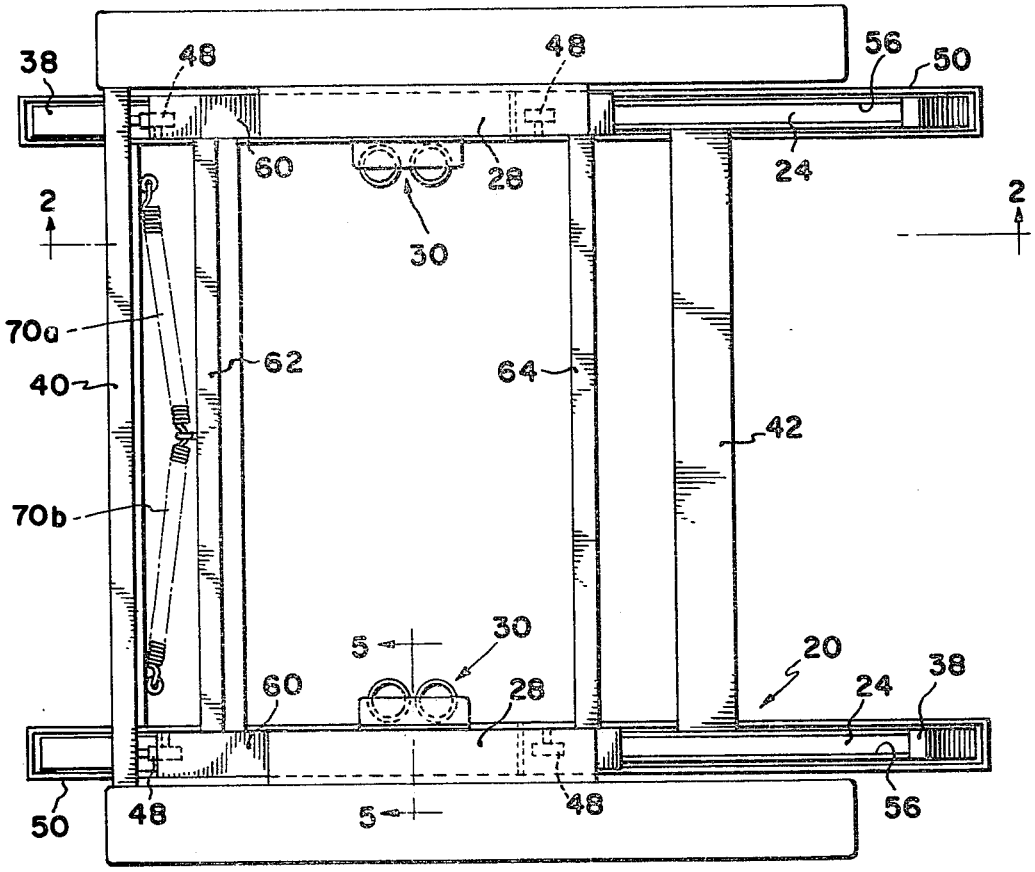
FIG. 1 is a top plan view with certain parts omitted of one embodiment of the invention.

A first embodiment of the present invention is shown in FIGS. 1-5 and, for purposes of explanation, will be referred to as the "rockable base" embodiment.

The rockable base embodiment includes a base designated generally 20, a carriage designated generally 22 which is supported for forward and rearward movement upon base 20 by roller tracks 24 fixedly mounted upon the base, and a chair frame designated generally 26 which is mounted upon carriage 22 for rocking movement relative to the carriage by rockers 28 and rocker spring mechanisms 30. A chair seat 32, a chair back 34, and optionally a foot rest 36 are mounted upon chair frame 26 for reclining movement relative to chair frame 26 by a suitable reclining chair linkage assembly designated generally R. The linkage R is illustrated only schematically since it may take the form of any of several commercially available linkages as, for example, that disclosed in U.S. Pat. No. 3,730,585. Details of a specific linkage have been omitted for the sake of clarity because any of the several conventional and well known linkages may be employed.

Base assembly 20 includes a pair of side frame members 38 which are rigidly interconnected to each other by transversely extending rear cross frame members 40 and 41 and front cross frame member 42.

Figure 2:
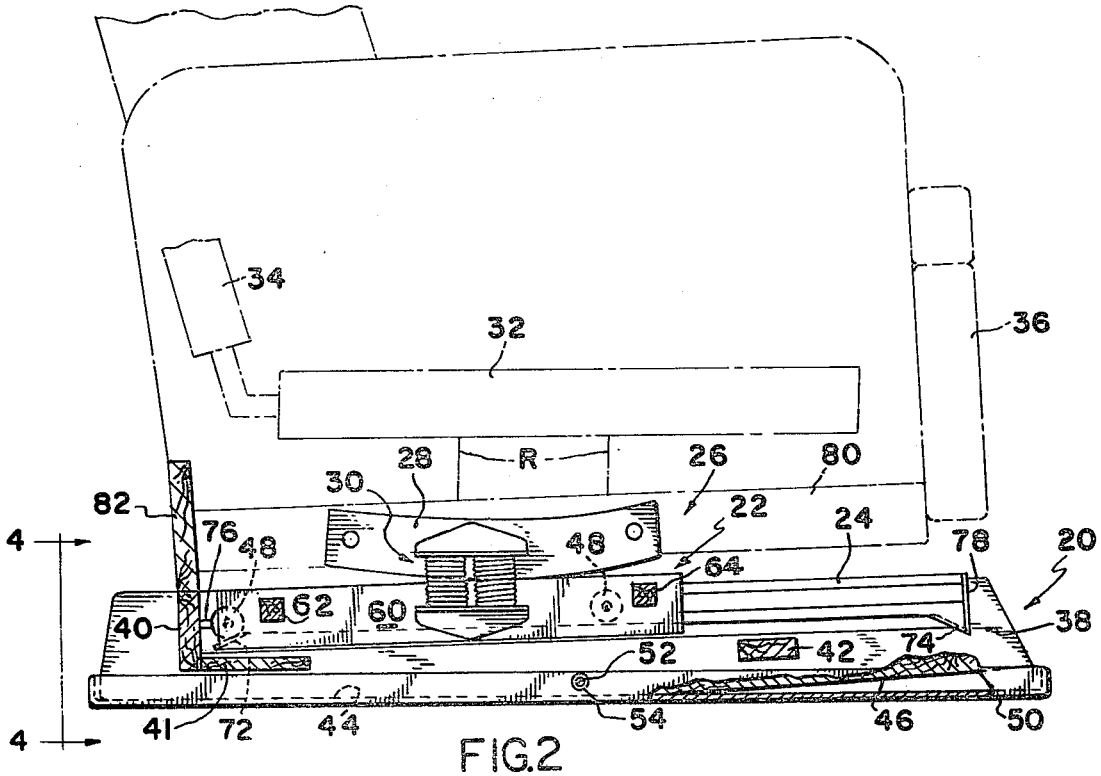
FIG. 2 is a cross sectional view taken on the line 2—2 of FIG. 1, with certain parts broken away or shown schematically.
Figure 3:
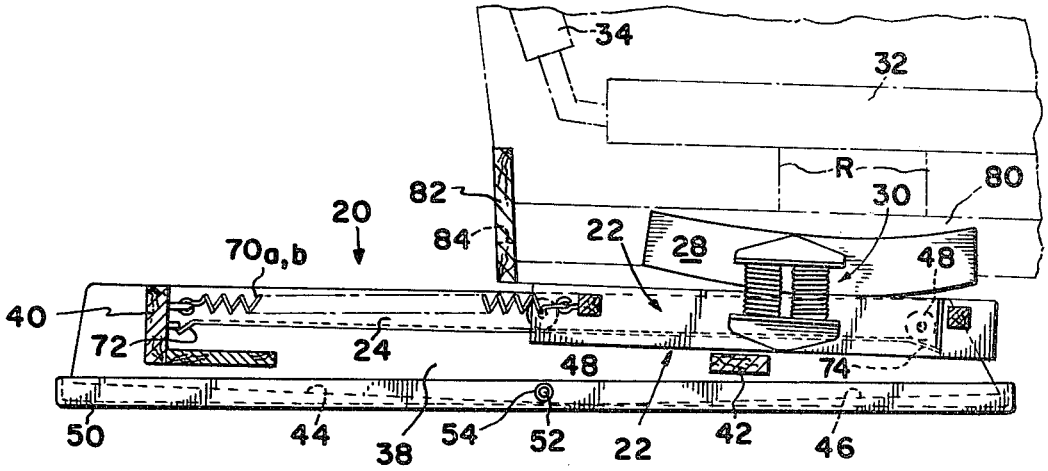
FIG. 3 is a cross sectional view, similar to that of FIG. 2, showing the carriage in a different position.

As best seen in the views of FIGS. 2 and 3, the lower surfaces of base side frame members 38 are formed with a flat portion 44 which constitutes approximately the rearward half of the lower surface of member 38 and a forwardly and upwardly inclined flat surface 46 which constitutes approximately the forward half of the lower surface of the member 38. As best seen in FIG. 2, when the chair is in its normal upright position, the center of gravity of the chair, which is approximately in vertical alignment with the centers of rocking spring mechanisms 30, is located above the rearward flat portion 44 of base side frame member 38, and thus the chair tends to rest stably in the position shown in FIG. 2. When the chair is in the normal rest position of FIG. 2, roller tracks 24, which are fixedly mounted on the inner sides of base side frame members 38, are slightly inclined downwardly toward the rear of the chair, or to the left as viewed in FIG. 2, thus gravitationally urging the carriage 22, which is supported by rollers 48 in tracks 24, to its rearward limit of movement relative to base 20, as viewed in FIG. 2.

Referring now to FIG. 3, it is seen that upwardly inclined forward surfaces 46 of members 38 allow base 20 to be rocked forwardly, as by a forward shifting of the weight of an occupant of the chair, to a position such that tracks 24 incline slightly downwardly toward the front of the chair, in which event carriage 22 is gravitationally biased toward its front limit of movement, illustrated in FIG. 3.

In order to achieve a smooth rocking action of the base 20, as in the case where the chair might be located on a rough or nubby surfaced carpet, side frame members 38 of the base may be received within a pair of rigid channel shaped mounting shoes 50 which provide a smooth flat surface supporting the lower surfaces 44 and 46 of side frame members 38. To retain shoes 50 in position, as when the chair is being moved, pins 52 extending transversely across the channel shaped shoes 50 are loosely received within enlarged bores 54 in side frame members 38. The pins 52 function solely as retaining members and the loose fit of the pins 52 in bores 54 permits free and unrestrained rocking movement of members 38 in shoes 50.

Figure 5:
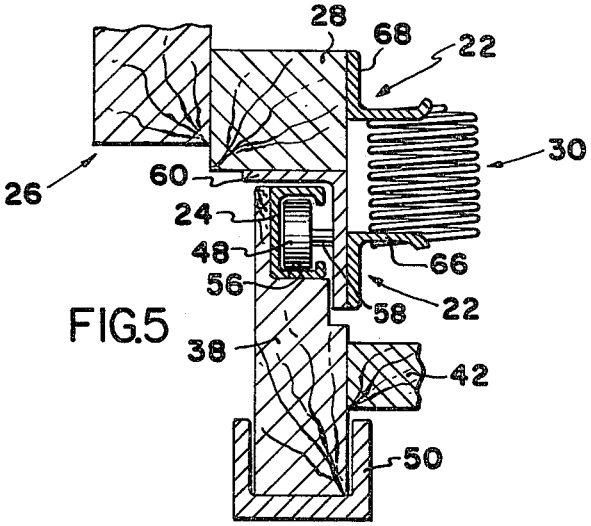
FIG. 5 is a detailed partial side view taken approximately from the line 5—5 of FIG. 1.

Referring particularly now to FIGS. 1 and 5, roller tracks 24 are of generally C-shaped transverse cross section and are fixedly secured to side frame members 38 of base 20 within a recess 56 in members 38. Rollers 48 of carriage 22 are retained within track members 24, as best seen in FIG. 5, and are rotatably mounted on axles 58 fixedly mounted to right angle formed members 60 which constitute opposed side frame members of carriage 22. As best seen in FIG. 1, transversely extending cross frame members 62, 64 fixedly interconnect members 60 in a rigid frame assembly to constitute carriage 22.

In further reference to FIG. 5, the vertical webs of side frame members 60 of carriage 22 serve to mount the rollers 48 of the carriage, while the upper surfaces of the horizontal webs of members 60 serve as rocking supports or platforms for rockers 28. The rocker spring mechanisms 30, which are of conventional construction, include upper and lower spring brackets 66, 68, which are respectively fixedly secured to side frame members 60 of carriage 22 and to rockers 28 which are in turn fixedly secured to side frame members 80 of chair frame 26.

Carriage 22 is normally biased to its rearward end limit of movement in tracks 24 by a pair of return springs 70*a*, 70*b*, see particularly FIG. 1, which are interconnected in a generally V-shaped arrangement between rear cross frame member 40 of base 20 and the rear cross frame member 62 of carriage 22. The geometry of the connection of springs 70*a*, 70*b* is such that a relatively small spring retaining force is exerted upon the carriage 22 when the carriage is located, as shown in FIG. 1, at its rearward end limit of movement relative to base 20. As shown in FIG. 1, when carriage 22 is at its rearward end limit of movement, the tension springs 70*a*, 70*b* are at a minimum extension and the line of action of the spring is such that only a very small component of the spring force is exerted in the fore and aft direction of the chair. It is believed apparent that when the carriage is moved forwardly from the position shown in FIG. 1, springs 70*a*, 70*b* will be extended. As the carriage moves forwardly the included angle between the two extending springs will become reduced, thereby applying an increased force component in the fore and aft direction, at the same time the spring tension force is increasing, so that a maximum spring force is exerted when the carriage is at its extreme forward end limit of movement relative to base 20.

To provide a detent-like retaining action in the carriage when it is at either its forward or end limit of movement, the forward and rearward ends of the roller supporting surfaces of tracks 24 are struck downwardly as at 72, 74 (FIG. 3) to provide a slight depression into which the rearward or forward rollers 48 of carriage 22 will drop when the carriage is at its rearward or forward end limit of movement. Positive end stops such as 76, 78 (FIG. 2) extend across the roller tracks 24 to provide a positive end limit of movement for the carriage.

Figure 4:
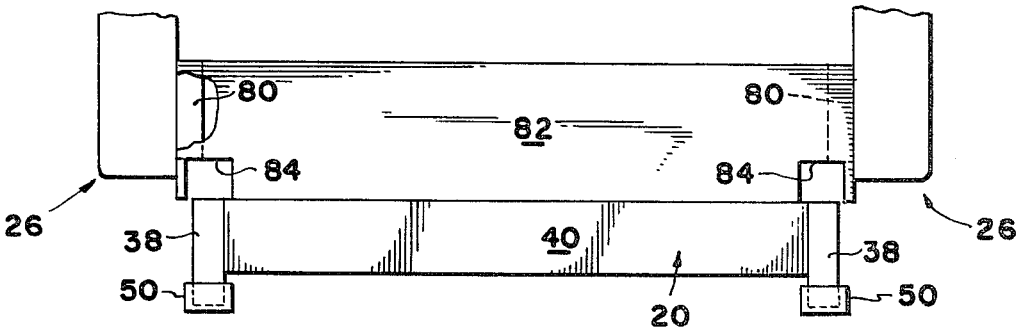
FIG. 4 is a detailed cross sectional view taken on the line 4—4 of FIG. 2.

Like carriage 22, chair frame 26 is constructed with a pair of side frame members 80 to which rocker elements 28 are fixedly secured, a front cross frame member, not shown, and a rear cross frame member 82 which extends transversely between frame members 80 at their rearward ends. Referring particularly to FIGS. 2 and 4, the rear cross frame member 82 of chair frame 26 functions as a stop to prevent rearward rocking movement of the chair when the carriage is at its rearward end limit of movement. As best seen in FIG. 2, when the carriage is at its rearward end limit of movement, the rear cross frame member 82 of the chair frame rests upon the rear cross frame member 40 of base 20 so that the chair frame cannot be rocked rearwardly on rocking elements 28 when the carriage is in this latter position. Recesses 84 cut into the opposite lower corners of cross frame member 82 provide rocking clearance between rear cross frame member 82 of the chair frame and side frame members 38 of the base 20 when carriage 22 is moved forwardly from its rearward end limit, shown in FIG. 2, to a location such that the rear cross frame member 82 of the chair frame has moved forwardly clear of rear cross frame member 40 of the base.

Operation of the rockable base embodiment shown in FIGS. 1–5 is as follows.

Referring first to FIGS. 1 and 2, in these two views the chair is disclosed with its seat, back and foot rest in a normal upright position, and with carriage 22 at its rearward end limit of movement, with the rear carriage rollers 48 seated in the rear detent or struck down portion 72 of tracks 24. As previously described, with the unoccupied chair in the position of FIGS. 1 and 2, the center of gravity of the chair is vertically located above the flat portions 44 of the lower surfaces of side frame members 38 of base 20, and hence the chair is in a stable position as shown in FIGS. 1 and 2. At this time, rear cross frame member 82 of the chair frame rests upon chair cross frame member 40 of the base 20, hence it is not possible to rock the seat and back of the chair rearwardly upon rocking elements 28, because the abutment of cross frame members 82 and 40 prevent this action.

If an occupant is seated in the chair when the chair is in the FIGS. 1 and 2 positions, the center of gravity of the chair with respect to the base is not altered appreciably and still remains rearwardly of the forward end of flat surfaces 44 of the base so that the chair will remain at its rearward end limit of movement with the seat and back in their normal upright positions, as long as the occupant sits in a normal position in the chair.

In order to condition the chair for rocking or reclining movement, the occupant of the chair shifts his weight forwardly, as by a forward rocking action. This shifts the center of gravity of the chair, as related to the supporting surfaces of base 20, forwardly of the juncture of the flat and inclined surfaces 44 and 46 of side frame members 38 of the base. This shifting of the center of gravity by the chair occupant acts to rock the entire chair, including base 20, forwardly on members 50 to shift the tracks 24 from their previously downwardly and rearwardly inclined positions shown in FIG. 2 to the downwardly and forwardly inclined position on FIG. 3. Because the carriage supporting track 24 is now tilted downwardly toward the front, the carriage is gravitationally biased forwardly and the slight acceleration imparted to the carriage by the forward rocking movement of the occupant of the chair is sufficient to shift the rear carriage rollers 48 out of detents 72, so that the carriage is free to roll forwardly along tracks 24 against the initial relatively insignificant rearward biasing action of return springs 70*a*, 70*b*. The forward movement of the carriage in turn shifts the center of gravity of everything supported by the carriage forwardly to further rock base 20 forwardly on the surface 46 so that the gravitational bias urging the carriage forwardly further increases to maintain forward movement of the carriage in the face of the increasing rearward bias exerted by springs 70*a*, 70*b*. When the carriage reaches its forward end limit of movement, FIG. 3, the forward rollers 48 of the carriage drop into the depressions created by struck down portions 74. At this time, the chain back has been shifted forwardly a sufficient distance so that rocking or reclining movement of the chair back is provided with sufficient clearance from any wall or other object which may be located closely adjacent the rearward side of the chair base.

The tensile force or return springs 70*a*, 70*b* is chosen such that the weight of the ocupant gravitationally biasing carriage 22 against its forward end limit of movement on the now downwardly inclined tracks 24 substantially exceeds the return biasing action exerted by the springs 70*a*, 70*b* when the chair is in its forward position. The occupant is thus able to rock the chair on rocking elements 28 or to shift the chair seat and back into a reclined position controlled by reclining linkage R as desired.

When the occupant gets out of the chair, the action of reclining linkage R is such that in rising from the chair the occupant restores the seat and back of the chair to their normal upright positions. When the weight of the occupant is released from the chair seat and back, the biasing action of springs 70*a*, 70*b* will exceed the gravitational force exerted by the weight of the carriage supported portions of the chair and the springs will draw the carriage back toward the rearward ends of the tracks 24. As the center of gravity of the carriage supported elements shifts rearwardly, side frame members 38 of the base begin to rock back toward their normal rest position shown in FIG. 2, and when the carriage, under the influence of springs 70*a*, 70*b* arrives at its rearward end limit of movement shown in FIG. 2, the center of gravity of the carriage supported element is now located vertically above the flat portions 44 of side frame members 38 of the base so that the assembly is returned to the stable position shown in FIGS. 1 and 2.

Figure 6:
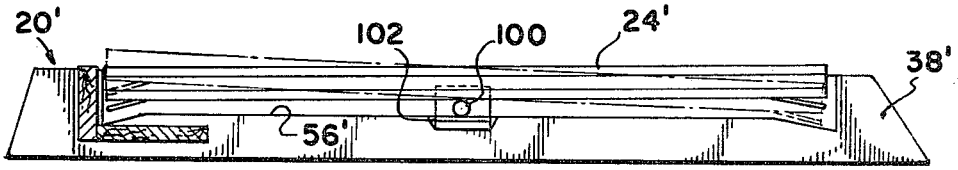
FIG. 6 is a partial side elevational view of a second embodiment of the invention.

A second embodiment of the invention, which can best be described as the "rocking track" embodiment is partially illustrated in FIG. 6. The FIG. 6 embodiment differs from the previously described rocking base embodiment of FIGS. 1–5 only in that the base 20' of the rocking track embodiment of FIG. 6 rests in a stationary position upon the floor and the roller tracks 24' are mounted for pivotal movement on the side frame members 38' of the base by pivots 100 rotatably received in brackets 102 fixedly mounted on the respective side members 38'.

Pivot 100 of the FIG. 6 embodiment is so located that the center of gravity of the carriage supported elements of the chair is located rearwardly of the pivot when the carriage is at its rearward end limit of movement with the chair in its normal upright position.

In essence, the difference between the embodiment of FIGS. 1–5 and the embodiment of FIG. 6 is that in the embodiment of FIGS. 1–5, the carriage supporting roller tracks 24 are fixedly mounted on the base 20 which is rocked as a unit to shift the tracks 24 from a rearwardly inclined orientation to a forwardly inclined orientation. In the embodiment of FIG. 6, the tracks 24 themselves are pivotally mounted on the base by pivots 100 to accommodate the required shifting movement. Positive stops for movement of the tracks relative to the base are provided by the configuration of the recess 56 in which the tracks 24' are mounted.

The carriage, chair frame, reclining linkage, seat, back and foot rest are identical between the FIGS. 1–5 embodiment and the embodiment of FIG. 6 and thus have not been illustrated in FIG. 6.

A third embodiment of the invention is illustrated in FIGS. 7–13 and will be referred to as the "rockable carriage" embodiment. In this third embodiment, the roller-track arrangement of the previously described embodiments is reversed, with the rollers of the rockable carriage embodiment being mounted upon the stationary base at fixed locations and the roller receiving tracks constituting a portion of the carriage.

Figure 7:
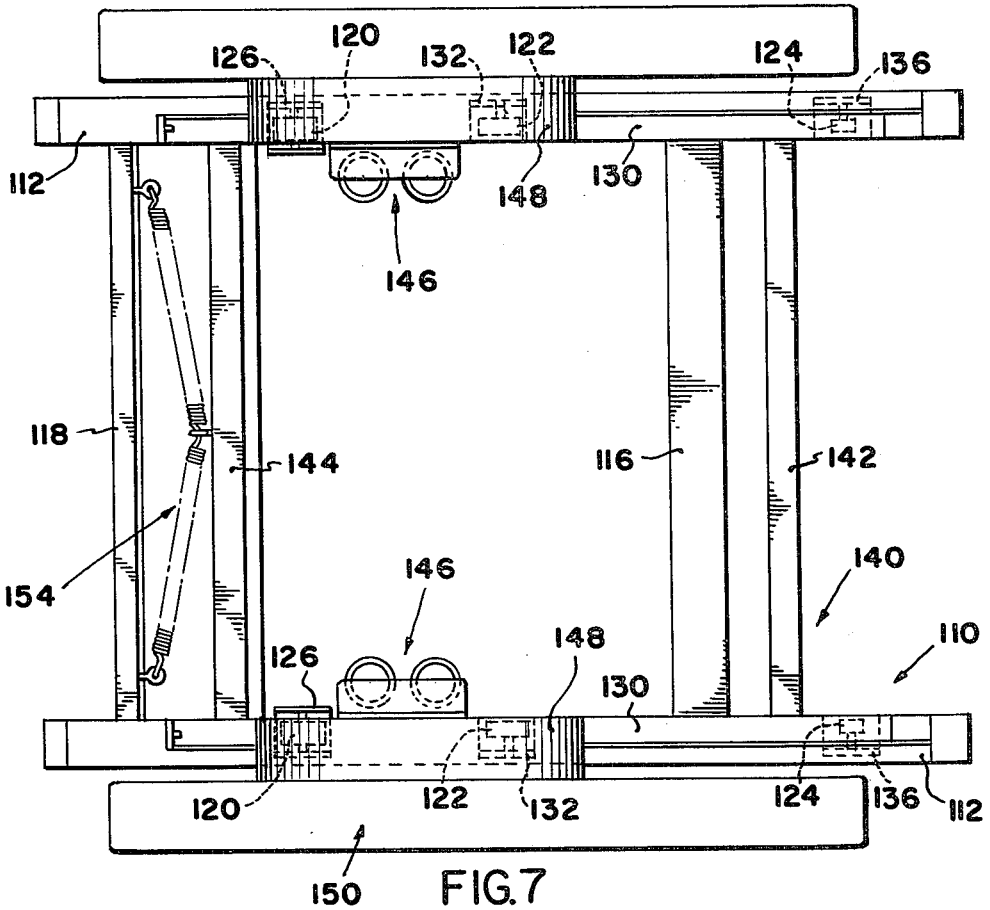
FIG. 7 is a top plan view similar to FIG. 1 of a third embodiment of the invention.
Figure 8:
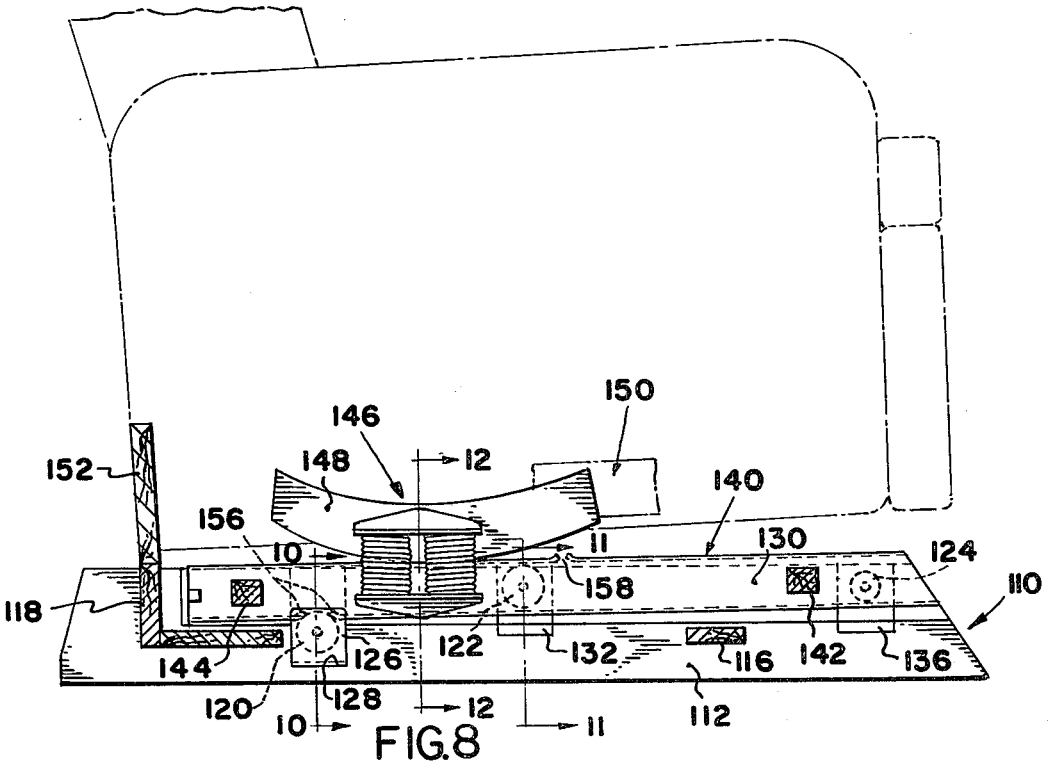
FIG. 8 is a side elevational view, similar to FIG. 2, of the FIG. 7 embodiment.
Figure 9:
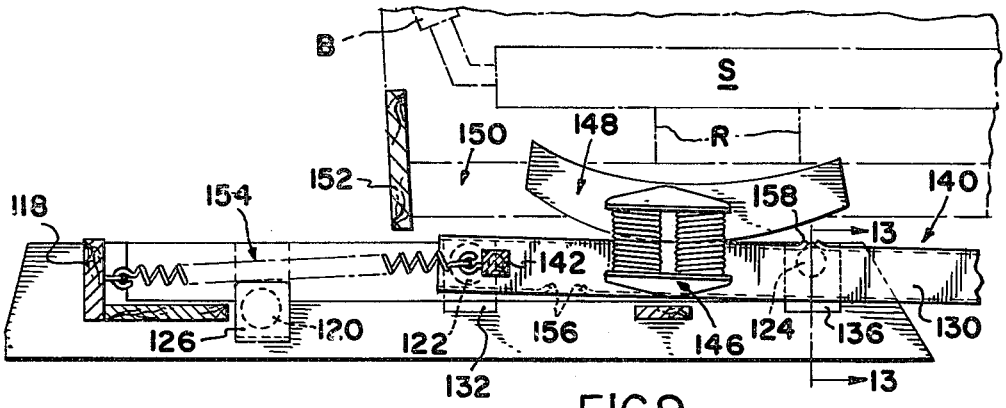
FIG. 9 is a cross sectional view showing the structure of FIG. 8 in a different position.

Referring particularly to FIGS. 7, 8, and 9, the rockable carriage embodiment includes a base assembly designated generally 110 having a pair of spaced opposed side frame members 112 fixedly interconnected to each other as by front and rear cross frame members 116, 118. Each of frame members 112 has a series of three rollers mounted for free rotation with recesses on the inner sides of frame members 112, the rollers including a rear roller 120, a central roller 122, and a front roller 124. Base assembly 110 is formed with flat lower supporting surfaces to rest in a stationary position on the floor at all times, and the respective rollers 120, 122, and 124 are mounted at fixed locations on the base and move only in rotation relative to the base.

Figure 10:
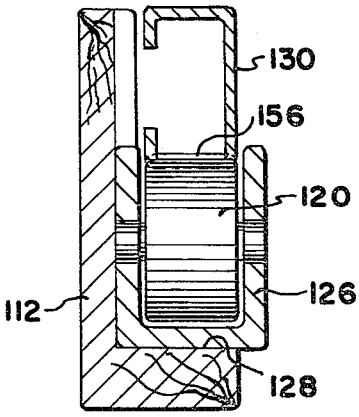
FIG. 10 is a detailed cross sectional view taken on the line 10—10 of FIG. 8.

As best seen in FIG. 10, rear roller 120 is rotatably supported within a U-shaped bracket 126 which is fixedly secured by means not shown to side frame member 112 within a recess 128. Roller 120 is vertically located on side frame member 112 at a position such that the lower surface of the roller track 130 of the rockable carriage embodiment rests upon roller 120.

Figure 11:
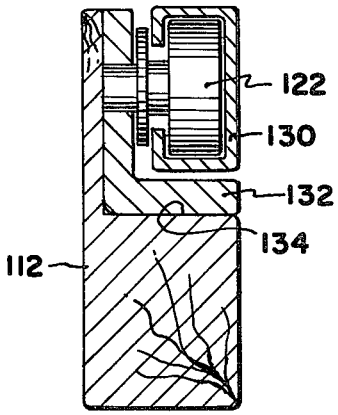
FIG. 11 is a detailed cross sectional view taken on the line 11—11 of FIG. 8.
Figure 12:
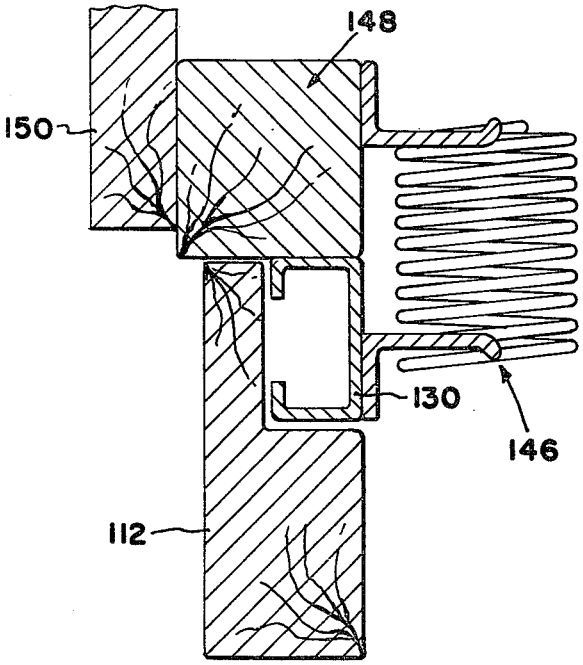
FIG. 12 is a detailed cross sectional view taken on the line 12—12 of FIG. 8.

Referring now to FIG. 11, it is seen that central roller 122 is rotatably supported from an L-shaped bracket 132 which is likewise fixedly mounted by means not shown upon side frame member 112 within a recess 134. Central roller 122 is received within roller track 130, and as best seen by a comparison of FIGS. 10 and 11, central roller 122 is mounted at a location somewhat higher than that of roller 120.

Figure 13:
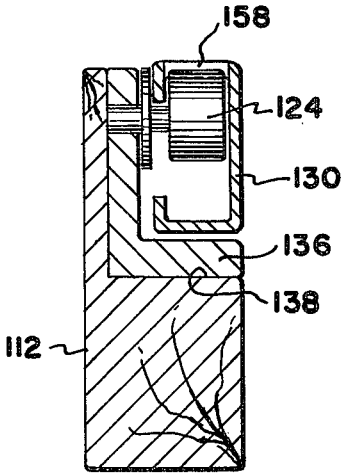
FIG. 13 is a detailed cross sectional view taken on the line 13—13 of FIG. 9.

Referring now to FIG. 13, front roller 124 is likewise rotatably supported upon an L-shaped bracket 136 fixedly mounted within a recess 138 in side frame member 112. Like central roller 122, front roller 124 is received within roller track 130. It should be noted that the diameter of front roller 124 is substantially smaller than that of central roller 122. The reduced diameter of roller 124 as compared to the inerior vertical clearance within roller track 130 accommodates rocking movement of track 130 upon roller 122 which is limited by the engagement of front roller 124 either with the internal surface of track 130, as shown in FIG. 13, or with the lower internal surface of track 130 (see FIG. 8).

In the rockable carriage embodiment of FIGS. 7–13, the roller tracks 130 constitute the side frame members of a carriage designated generally 140, the two roller tracks 130 being rigidly interconnected to each other by front and rear cross frame members 142, 144 to constitute the carriage 140. Rocker spring units 146 couple the rocking elements 148 of a chair frame designated generally 150 to track members 130 in the same manner that rocker springs 30 of the FIG. 1 embodiment coupled the carriage 22 to the rocking elements 28 of the FIG. 1 embodiment. As in the FIG. 1 embodiment, a suitable reclining linkage R supports a chair seat S and a chair back B upon chair frame 150. A rear cross frame member 152 on chair frame 150 cooperates with rear cross frame member 118 of the base of the FIGS. 7–13 embodiment to prevent rearward rocking movement of the chair assembly when the carriage 140 is at its rearward end limit of movement as illustrated in FIG. 8.

Carriage 140 is movable between front and rear end limits of movement relative to the stationary base 110, the carriage 140 being shown at its rearward end limit of movement in FIG. 8 and at its forward end limit of movement in FIG. 9. As was the case of the FIGS. 1–5 rockable base embodiment, the rockable carriage embodiment of FIGS. 7–13 includes a return spring arrangement designated generally 154 which is coupled between rear cross frame member 118 of base 110 and rear cross frame member 144 of carriage 140 to function in the same manner as the return spring arrangement 70*a*, 70*b* of the FIGS. 1–5 embodiment.

Operation of the rockable carriage embodiment of FIGS. 7–13 is as follows:

Referring first to FIG. 8, the chair is shown with carriage 140 at its rearward end limit of movement relative to base 110 with the various chair elements in their normal upright position. When in this position, carriage 140 is supported by the engagement of rear rollers 120 with the under surface of tracks 130 and by the engagement of central rollers 122 with the upper interior surfaces of tracks 130. The center of gravity of the chair, which is generally in vertical alignment with the vertical center line or rocker spring mechanism 146, is located moderately rearwardly of central rollers 122. Thus the rearward portions of tracks 130 are gravitationally biased downwardly, tending to tilt the tracks to a rearwardly and downwardly inclined orientation, the rearward inclination being limited by the engagement of rear rollers 120 on the under surfaces of the tracks. A detent-like retaining action tending to constrain the carriage from advancing in this position is provided by upwardly struck tabs 156 which form a downward opening recess which receives the upper portion of rear rollers 120, as best seen in FIG. 8. It will be noted from FIG. 8 that with the chair in its normal rest position at its rearward end limit of movement, front rollers 124 are substantially in engagement with the lower internal surfaces of tracks 130 with a substantial vertical clearance between the upper sides of rollers 124 and the upper internal surfaces of tracks 130.

To condition the chair for rocking or reclining, the occupant of the chair exerts a forward rocking action which tilts the tracks 130 of the carriage forwardly about the rocking axis defined by central rollers 122. The forward tilt of tracks 130 swings the rearward portions of the tracks upwardly to lift the lower or under surfaces of the tracks clear of rear rollers 120 and to swing the forward portions of the tracks 130 downwardly until front rollers 124 engage the upper internal surfaces of tracks 130, see FIG. 13. With the track thus inclined forwardly and downwardly, the track is free to roll forwardly relative to base 110 upon rollers 122, 124, thus moving the carriage to the forward end limit of movement shown in FIG. 9. A detent-like retaining action constraining the carriage from retracting from its forward end limit of movement is provided with upstruck portions 158 in tracks 130 which provide recesses receiving front rollers 124 when the carriage is at its forward end limit of movement.

When the carriage is at its forward end limit of movement, sufficient clearance from a wall located closely adjacent the rear of the base 110 is provided to accommodate rocking and reclining movement of the chair. While the chair is occupied, the gravitational bias holding the carriage at its forward end limit of movement exceeds the rearward biasing action applied by the return spring assembly 154 as described above in connection with the embodiments of FIGS. 1–5. Similarly when the occupant arises from the chair, the reclining linkage automatically restores the seat, back, and foot rest (if any) to the normal upright position and the reduced weight acting on the carriage is now insufficient to overcome the spring bias of return spring assembly 154 which returns the carriage to its rearward end limit of movement. As the carriage moves to its rearward end limit of movement under the action of spring assembly 154, the center of gravity of the chair passes rearwardly beyond central rollers 122 and the carriage then returns to the rearward and downward inclination of FIG. 8 as the carriage reaches its rearward end limit of movement.

Figure 14:
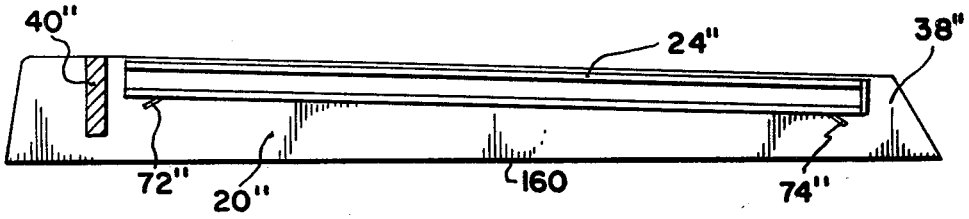
FIG. 14 is a partial side elevation of a fourth embodiment of the invention.
Figure 15:
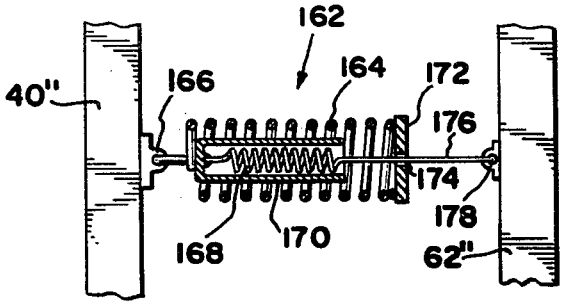
FIG. 15 is a cross sectional view of the return spring assembly of the fourth embodiment.

A fourth embodiment of the invention is illustrated in FIGS. 14 and 15. The embodiment of FIGS. 14 and 15 is in essence a modification of the embodiment of FIGS. 1–5 and is identical with the construction previously described in connection with FIGS. 1–5 with the exception of a modification to the chair base and the substitution of a different form of return spring assembly. Other than these two modifications, the construction of the fourth embodiment, referred to as the "fixed track" embodiment is identical to that of FIGS. 1–5, hence only the modified portions of the construction have been illustrated in FIGS. 14 and 15. Reference numerals with " employed in FIGS. 14 and 15 illustrate portions of the structures identified by unprimed corresponding reference numerals in FIGS. 1–5.

Referring first to FIG. 14, it is seen that in the "fixed track" embodiment, the side frame members 38" of base 20" are formed with a continuous flat lower surface 160 which supports the base 20" in a fixed and stationary position at all times. The carriage roller receiving tracks 24" of the fixed track embodiment are fixedly secured to base side frame members 38" permanently in a forwardly and downwardly inclined position. As was the case in the embodiment of FIGS. 1–5, the roller supporting surfaces of track 24" are formed with downwardly struck sections 72" and 74" respectively located near the rearward and forward ends of tracks 24". As was the case in the embodiment of FIGS. 1–5, the downwardly struck portions 72" of tracks 24" provide detent-like recesses which receive the rear rollers of the carriage to provide a detent-like retaining action to normally maintain the carriage at its rearward end limit of movement relative to base 20" (see, for example, FIG. 2). A similar action occurs when the carriage is at its forward end limit of movement with its front rollers received in the detent-like recesses 74" at the forward end of the track (see, for example, FIG. 3).

Essentially the modification of the base 20" in the embodiment of FIG. 14 presents the same situation as if wedges were placed under the flat rearward portions 44 of base 20 of the FIG. 1 embodiment to permanently position the base 20 on its forward under surfaces 46 as illustrated in FIG. 3.

Because the tracks 24" of the FIG. 14 and 15 embodiment are permanently tilted forwardly and downwardly so that the carriage is always gravitationally biased toward the forward end limit of movement, a modified form of return spring assembly designated generally 162 (FIG. 15) is substituted for the return spring arrangement **70*a*, 70*b* of the FIG. 1–5 embodiment. Return spring assembly 162 includes a relatively large, heavy and stiff spring 164 which is fixedly coupled at its rearward (left-hand end as viewed in FIG. 15) to the rear cross frame member 40" of base 20" as at 166. A second helical coil spring 168 which is substantially lighter and less stiff than spring 164 is coaxially mounted within the coils of spring 164, preferably within a hollow tube 170 which prevents the coils of the two springs from becoming entangled with each other. The rearward or left-hand end of the tube 170 may be closed, and the left-hand end of spring 168, as viewed in FIG. 15, is fixedly secured to the closed end of the tube which is in turn fixedly secured to the rear or left-hand end of outer spring 164. Effectively, the respective left-hand ends of spring 164, tube 170 and spring 168 are fixedly anchored to the rear cross frame member 40"** of the chair base.

An end cap 172 is fixedly secured to the right-hand end of outer spring 164 and a relatively small bore 174 through end cap 172 slidably passes an elongated stem portion 176 of spring 168, the stem 176 being anchored to the rear cross frame member 62" of the carriage as at 178.

In FIG. 15, return spring assembly 162 is shown in the configuration it assumes when the chair carriage is at its rearward end limit of movement relative to the base. At this time, spring 168 is under slight tension, while spring 164 is entirely relaxed.

With the chair of FIG. 14 and 15 embodiment at its rearward end limit of movement, the rear rollers of the carriage are received in the detent-like depressions 72" of tracks 24" and the chair is thus releasably retained with the carriage at its rearward end limit of movement.

To shift the carriage to its forward end limit of movement, it is necessary for the occupant of the chair to supply a forward impetus to the carriage, as by rocking forwardly, sufficient to carry the rear rollers of the carriage out of detents 72". Once the rear rollers of the carriage are out of detents 72", the carriage is free to roll downhill along the forwardly inclined tracks 24" to its forward end limit of movement.

Referring now particularly to FIG. 15, as the carriage, represented by its rear cross frame member 62" in FIG. 15, moves to the right or forwardly away from the stationary base, represented by its rear cross frame member 40", spring 168 begins to extend, but applies only a relatively light rearwardly acting biasing action, which is insufficient to restrain the occupied chair and carriage now moving downhill along the inclined tracks 24". Spring 168 continues to extend until its forwardmost coil seats against the inner side of end cap 172 of spring 164. At this instant, the forward or right-hand end of spring 164 is effectively coupled to the rear cross frame member 62" of the carriage via the elongated stem 176 of spring 168. Further forward movement of the carriage thus is resiliently resisted by the relatively stiff spring 164 which now begins to extend as the carriage moves forwardly toward its forward end limit of movement. While the biasing action of spring 164 is unable to overcome the gravitational bias urging the carriage toward its forward end limit of movement, it does exert a slight braking action on the movement of the carriage as it approaches its forward end limit of movement.

The spring characteristic of spring 164 is chosen so that when the spring is extended with the carriage at its forward end limit of movement, the rearward biasing action applied by spring 164 is large enough to overcome the gravitational bias holding the carriage and its supported chair elements at its forward end limit of movement when the chair is unoccupied, but is not large enough to overcome this gravitational bias when the weight of the chair occupant is added to that of the weight of the chair elements supported upon the carriage. Thus, the chair will remain at its forward end limit of movement as long as it is occupied, but when the occupant arises from the chair, return spring assembly 162 will automatically return the carriage to its rearward end limit of movement. Rocking and reclining of the chair at its forward end limit of movement occurs in the same manner as described above in connection with the embodiment of FIGS. 1–5.

While exemplary embodiments of the invention have been described, it will be apparent to those skilled in the art that the disclosed embodiments may be modified. Therefore, the foregoing description is to be considered exemplary rather than limiting, and the true scope of the invention is that defined in the following claims.

What is claimed is:

1. In an against-the-wall type reclining chair having a base, a chair frame, a chair seat and a chair back, and reclining linkage means mounting at least one of said seat and back upon said frame for movement relative to said frame between an upright position and a reclined position; chair frame on said carriage for movement therewith, cooperating track means and roller means mounting said carriage upon said base for gravitationally induced movement relative to said base along a path defined by said track means between a forward and a rearward end limit, and second mounting means supporting said track means for tilting movement between a rearwardly inclined position and a forwardly inclined positon to gravitationally induce movement of said carriage respectively to said rearward or to said forward end limit in accordance with the direction of inclination of said track means.

2. The invention defined in claim 1 wherein said second mounting means comprises means fixedly mounting said track means on said base to be disposed in said rearwardly inclined position when said base is in a normally maintained rest position, said base being rockable forwardly from said rest position to an actuated position wherein aid track means is in said forwardly inclined positon.

3. The invention defined in claim 2 wherein said base comprises a pair of side frame members located at opposite sides of said base and having floor engaging lower surfaces extending from front to rear of said base, the rearward portions of said surfaces being flat and the forward portions being upwardly and forwardly inclined, the center of gravity of those portions of said chair supported on said base being located above the flat portions of said surfaces when said carriaged is at said rearward end limit.

4. The invention defined in claim 3 wherein a forward movement of said chair frame initiated by an occupant of the chair is operable to shift said center of gravity forwardly into overlying relationship to said forward portions of said surfaces to tilt said base forwardly toward said actuated position to thereby gravitatively bias said carriage toward said forward end limit.

5. The invention defined in claim 4 further comprising spring means operable when said chair is unoccupied to return said carriage to said rearward end limit of movement.

6. The invention defined in claim 1 wherein said second mounting means comprises pivot means on said base supporting said track means for pivotal movement between said inclined positions.

7. The invention defined in claim 1 wherein said roller means comprises a pair of roller means mounted on said base with one of said pair of roller means spaced forwardly from the other, means mounting said track means on said carriage means, said track means having opposed vertically spaced parallel roller means engaging surfaces and one of said roller means having a diameter substantially less than the vertical spacing of said surfaces to accommodate tilting of said track means between one of said inclined positions wherein both of said roller means engage the uppermost of said surfaces and the other of said inclined positions wherein said one of said roller means is located adjacent the lowermost of said surfaces.

8. In a rockable against-the-wall type reclining chair having a base, a chair frame, a chair seat and a chair back, and reclining linkage means mounting said seat and back upon said frame for movement relative to said frame between an upright position and a reclined position; the improvement comprising carriage means supporting said chair frame for rocking movement thereon, track means supporting said carriage means for movement relative to said base between a forward and a rearward end limit of movement, support means supporting said track means for tilting movement between a forwardly inclined position and a rearwardly inclined position, the center of gravity of the assembled carriage means, frame, seat and back being located to gravitationally bias said track means to said rearwardly inclined position when said carriage means is at said rearward end limit and being located to gravitationally bias said track means to said forwardly inclined position when said carriage means is at said forward end limit and restraining means for preventing rearward rocking movement of said chair back when said carriage means is at said rearward end limit.

9. The invention defined in claim 8 further comprising spring means operable to overcome said gravitational bias when said chair is unoccupied to return said carriage means from said forward end limit to said rearward end limit.

10. The invention defined in claim 9 wherein the gravitational bias when said chair is occupied and said carriage meas is at said forward end limit exceeds the biasing force of said spring means urging said carriage means to said rearward end limit.

11. The invention as defined in claim 8 wherein a forward rocking movement of said chair frame upon said carriage means initiated by an occupant of said chair when said carriage means is at said rearward end limit is operable to shift said track means to said forwardly inclined position

12. The invention defined in claim 11 further comprising spring means operable when said chair is unoccupied to return said carriage means from said forward end limit to said rearward end limit.

13. The invention defined in claim 8 wherein said carriage means includes roller means received by said track means, and detent means in said track means receiving said roller means when said carriage means is at either of said end limits to exert an initial resistance against movement of said carriage means away from either of said end limits.

14. The invention defined in claim 8 further comprising means for preventing rearward rocking movement of said chair when said carriage means is located at less than a predetermined distance rearwardly of said forward end limit.

15. The invention defined in claim 8 wherein said support means comprises a stationary base, and pivot means mounting said track means on said stationary base for rocking movement between said inclined positions.

16. The invention defined in claim 8 wherein said support means comprises a support member having an elongate lower support surface, said support surface having a flat rearward portion and a forwardly and upwardly inclined forward portion, said track means being fixedly secured to said support member in rearwardly convergent relationship to said flat rearward portion of said support surface and in forwardly convergent relationship to at least a portion of said forward portion.

17. In a rockable against-the-wall type reclining chair having a base, a chair frame, a chair seat and a chair back, and reclining linkage means mounting said seat and back upon said frame for movement relative to said frame between an upright position and a reclined position; The improvement comprising a carriage, rocking means mounted on said carriage to support said chair frame for rocking movement on said carriage, cooperating track and roller means mounting said carriage upon said base for movement relative to said base between a forward and a rearward end limit, detent means in said track means operable when engaged with at least some of said rollers for releasably retaining said carriage at said rearward end limit, return spring means coupled between said base and said carriage for biasing said carriage to said rearward end limit, weight responsive means operable when said chair is occupied for disengaging said detent means by a forward shifting of the occupant's weight and for gravitationally maintaining said carriage at said forward end limit of movement against the biasing action of said return spring means and means for preventing rearward rocking movement of said chair back when said carriage means is at said rearward end limit.

18. The invention defined in claim 17 wherein said base is stationary and said track means are fixedly mounted on said base in a forwardly and downwardly inclined position.

19. The invention defined in claim 18 wherein said return spring means comprises a first tension spring coupled between said base and said carriage to bias said carriage rearwardly on said base, a second tension spring coupled at one end to said base and capable of exerting a biasing force substantially greater than that of said first spring, and means operable upon a predetermined extension of said first spring for coupling the other end of said second spring to said carriage to exert a rearward biasing action on said carriage.

* * * * *